US009604779B2

(12) United States Patent
Ristagno

(10) Patent No.: US 9,604,779 B2
(45) Date of Patent: Mar. 28, 2017

(54) PORTABLE TRASH CONTAINER

(71) Applicant: Peter J. Ristagno, Garfield Heights, OH (US)

(72) Inventor: Peter J. Ristagno, Garfield Heights, OH (US)

( * ) Notice: Subject to any disclaimer, the term of this patent is extended or adjusted under 35 U.S.C. 154(b) by 126 days.

(21) Appl. No.: 14/697,754

(22) Filed: Apr. 28, 2015

(65) Prior Publication Data

US 2016/0318709 A1 Nov. 3, 2016

(51) Int. Cl.

| | |
|---|---|
| ***B65D 88/52*** | (2006.01) |
| ***B65F 1/12*** | (2006.01) |
| ***B65F 1/14*** | (2006.01) |
| ***B65D 88/22*** | (2006.01) |
| ***B65D 37/00*** | (2006.01) |

(52) U.S. Cl.

CPC ..... *B65F 1/122* (2013.01); *B65D 37/00* (2013.01); *B65D 88/22* (2013.01); *B65D 88/52* (2013.01); *B65F 1/1473* (2013.01); *B65F 2220/106* (2013.01)

(58) Field of Classification Search

CPC ..... B65D 37/00; B65D 88/22; B65D 88/52; B65D 88/56; B65D 90/0033; B65D 90/205

See application file for complete search history.

(56) References Cited

U.S. PATENT DOCUMENTS 2,224,537 A * 12/1940 Cowan ..... B65D 33/02 220/9.2
3,128,811 A * 4/1964 Higgins ..... B65D 37/00 229/199
3,266,813 A * 8/1966 Bosko ..... B62B 3/00 280/47.11
4,646,357 A * 2/1987 Nattrass ..... B65D 88/1668 222/105
4,715,767 A 12/1987 Edelhoff et al.
5,344,048 A * 9/1994 Bonerb ..... B65B 69/0075 222/105
5,589,081 A 12/1996 Harris
5,607,237 A * 3/1997 LaFleur ..... B65D 88/1681 383/117
6,155,772 A 12/2000 Beale
6,390,675 B1 * 5/2002 Jardine ..... G01N 25/16 374/1
7,578,511 B2 * 8/2009 Sheehan ..... B65F 1/1468 280/47.34
7,757,851 B2 * 7/2010 Schnaars ..... B65D 88/1631 206/386
8,016,145 B2 * 9/2011 Perkins ..... B65D 77/061 206/509
8,092,141 B2 1/2012 Curotto et al.
(Continued)

FOREIGN PATENT DOCUMENTS

GB 2469660 A * 10/2010

*Primary Examiner* — James Keenan

(74) *Attorney, Agent, or Firm* — Howard M. Cohn; Daniel M. Cohn

(57) ABSTRACT

A portable trash container adapted to be used with an hydraulic-powered lift having a pair of forks extending from a truck, and method of use. The portable trash container includes an upper frame constructed of first and second side walls and first and second end walls, and a collapsible mesh container secured to the upper frame. A pair of tubes are secured to the first and second side walls to receive the pair of hydraulic-powered forks.

15 Claims, 4 Drawing Sheets

(56) References Cited

U.S. PATENT DOCUMENTS

| | | | | |
|---|---|---|---|---|
| 8,322,924 | B2 * | 12/2012 | Noble | B65F 1/122 220/666 |
| 8,668,186 | B1 | 3/2014 | Wagner | |
| 9,028,194 | B2 * | 5/2015 | Wahls | B65D 88/56 414/420 |
| 2007/0045483 | A1 * | 3/2007 | Johnson | B65F 1/0006 248/99 |
| 2008/0251471 | A1 * | 10/2008 | Inglese | B28B 7/06 210/800 |
| 2009/0001089 | A1 * | 1/2009 | Britt | B65D 88/1631 220/666 |
| 2010/0219096 | A1 | 9/2010 | Hay et al. | |
| 2012/0132662 | A1 | 5/2012 | Apps et al. | |

* cited by examiner

PORTABLE TRASH CONTAINER

TECHNICAL FIELD OF THE INVENTION

The present invention relates to a portable trash container and more particularly to a portable trash container utilized in conjunction with a front-loading truck.

BACKGROUND OF THE INVENTION

In many commercial and residential settings, trash collection is consolidated via conventional dumpsters prior to attendance by a local waste collection agency. Due to associated odors and other health concerns, dumpsters are generally located outdoors. The outdoor location further facilitates easy access by waste collection vehicles for lifting and emptying.

It is conventional practice to empty trash containers into the open-top, trash-receiving body of a trash pick-up truck by means of an automatically operable mechanism attached to the truck alongside the body. This equipment is used extensively in cities where residences and possibly at least certain commercial and industrial establishments are provided by the municipality with relatively large trash containers of uniform size and shape. Periodically, usually about once a week, the residences and other establishments place their trash containers in a suitable location, as at curb-side or in an alley, and the truck is driven from one trash container to the next. As the truck stops at each trash container, the mechanism moves laterally away from the truck, picks up the container, then retracts to its normal position alongside the truck and swings the container upwardly to an upside down position over the trash receiving body so that the trash in the container falls by gravity into the body. These motions are then repeated in reverse order to return the empty container to its original location.

SUMMARY OF THE INVENTION

According to an embodiment of the present invention, there is disclosed a portable trash container adapted to be used with an hydraulic-powered lift having a pair of forks extending from a truck. The portable trash container includes an upper frame constructed of first and second side walls and first and second end walls, and a collapsible mesh container secured to the upper frame. A pair of tubes are secured to the first and second side walls to receive the pair of hydraulic-powered forks.

According to another embodiment of the present invention, there is disclosed a method for using a portable trash container with a hydraulic-powered lift having a pair of forks extending from a truck. The method includes providing the portable trash container with an upper frame constructed of first and second side walls and first and second end walls and a collapsible mesh container secured to the upper frame, and providing a pair of tubes secured to the first and second side walls. The collapsible mesh container is moved in a collapsed state to a location away from the truck where an item is placed within the collapsible mesh container. The collapsible mesh container is moved to a location adjacent the hydraulic-powered lift having a pair of forks extending from the truck. The method includes inserting the pair of forks into the pair of tubes, and raising the pair of forks to raise the collapsible mesh container into an extended state. The method further includes inverting the collapsible mesh container and dumping the collapsible mesh container so that the item therein is dumped into a refuse compartment within the truck.

BRIEF DESCRIPTION OF THE DRAWINGS

The structure, operation, and advantages of the present invention will become further apparent upon consideration of the following description taken in conjunction with the accompanying figures (Figs.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader, and should not in any way be interpreted as limiting.

DETAILED DESCRIPTION OF THE PREFERRED EMBODIMENTS

Figure 1:
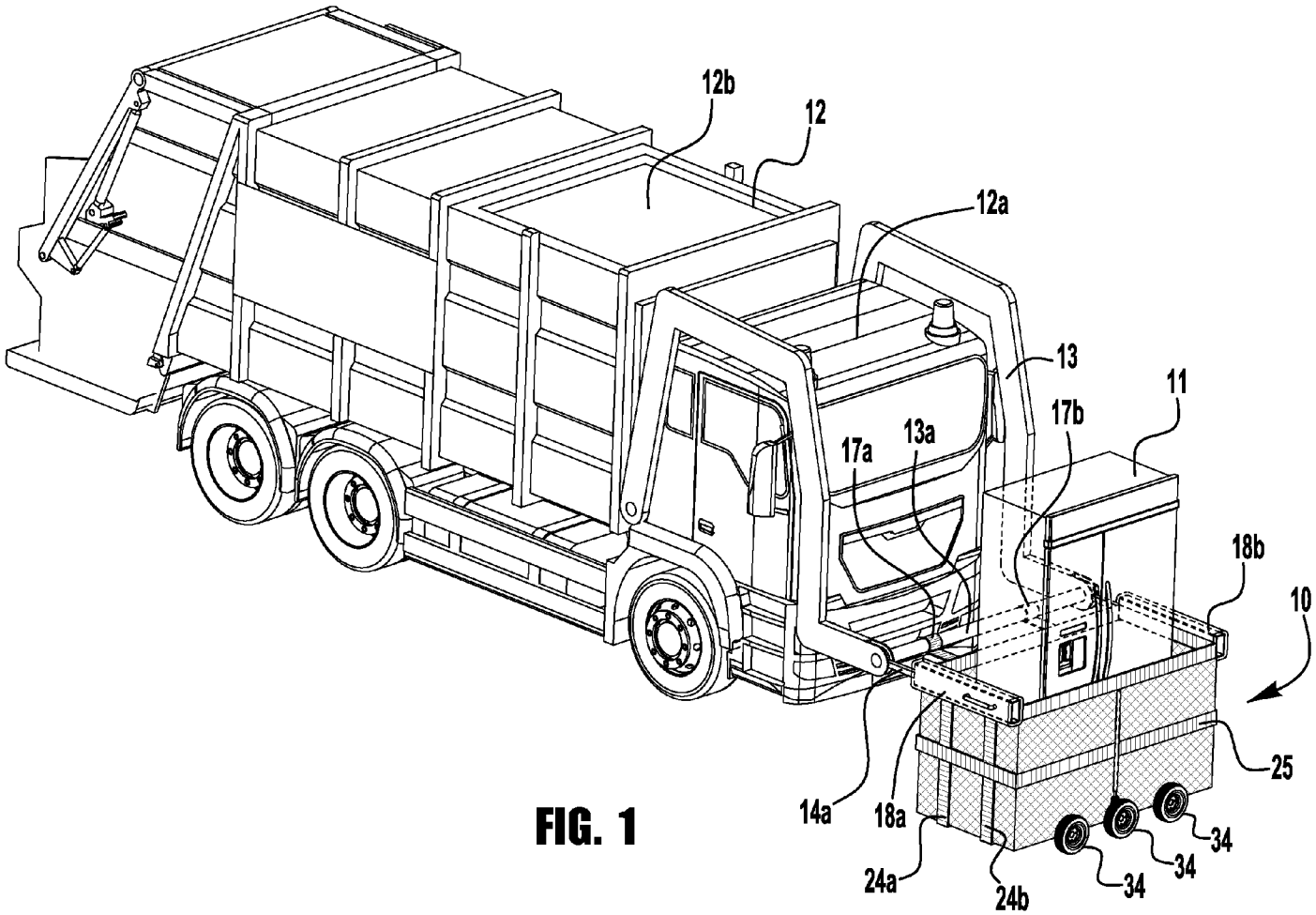
FIG. 1 is a front three-dimensional view of the portable trash container in use with a front-loading truck, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader, and should not in any way be interpreted as limiting.

Front-loading waste-collecting and hauling vehicles 12 are ubiquitous in the commercial refuse collection industry. Typically, when front-loading is employed, a heavy-duty vehicle or truck 12 is provided with a hydraulic-powered lift 13, including a pair of forks 14*a* and 14*b* situated to extend in front of the vehicle. The forks 14*a* and 14*b* of the truck 12 can be raised, lowered and tilted in front of the driver's cab so that an operator can see the forks, guide the forks into lifting engagement with a front-loadable refuse container 10 and lift the container with the forks. The portable trash container 10 is designed to be utilized in conjunction with a front-loading truck 12. Bulk items may be placed within the portable trash container 10, which is a portable, mesh, low profile container.

As illustrated in FIG. 1, the portable trash container 10 is designed to accommodate of variety of items to be placed in the truck 12, such as a refrigerator 11. The front-loading truck 12 typically has a front cab 12*a* with a large refuse compartment 12*b* behind the cab. A hydraulic-powered lift 13, including a pair of forks 14*a* and 14*b* extend in front of the truck 12 that are adapted to be inserted into corresponding tubes 18*a* and 18*b* associated with the portable trash container 10. Typically tubes 18*a* and 18*b* having a rectangular cross section however, any suitable cross section that can receive the forks 14*a* and 14*b* can be used. The forks 14*a* and 14*b* are able to lift the portable trash container 10 from its initial, refuse collection position on the ground, then over the cab 12*a* of the truck 12 and invert the container 10 to dump its contents into the refuse compartment 12*b* located behind the cab for dumping the contents of the trash container there into.

Figure 2:
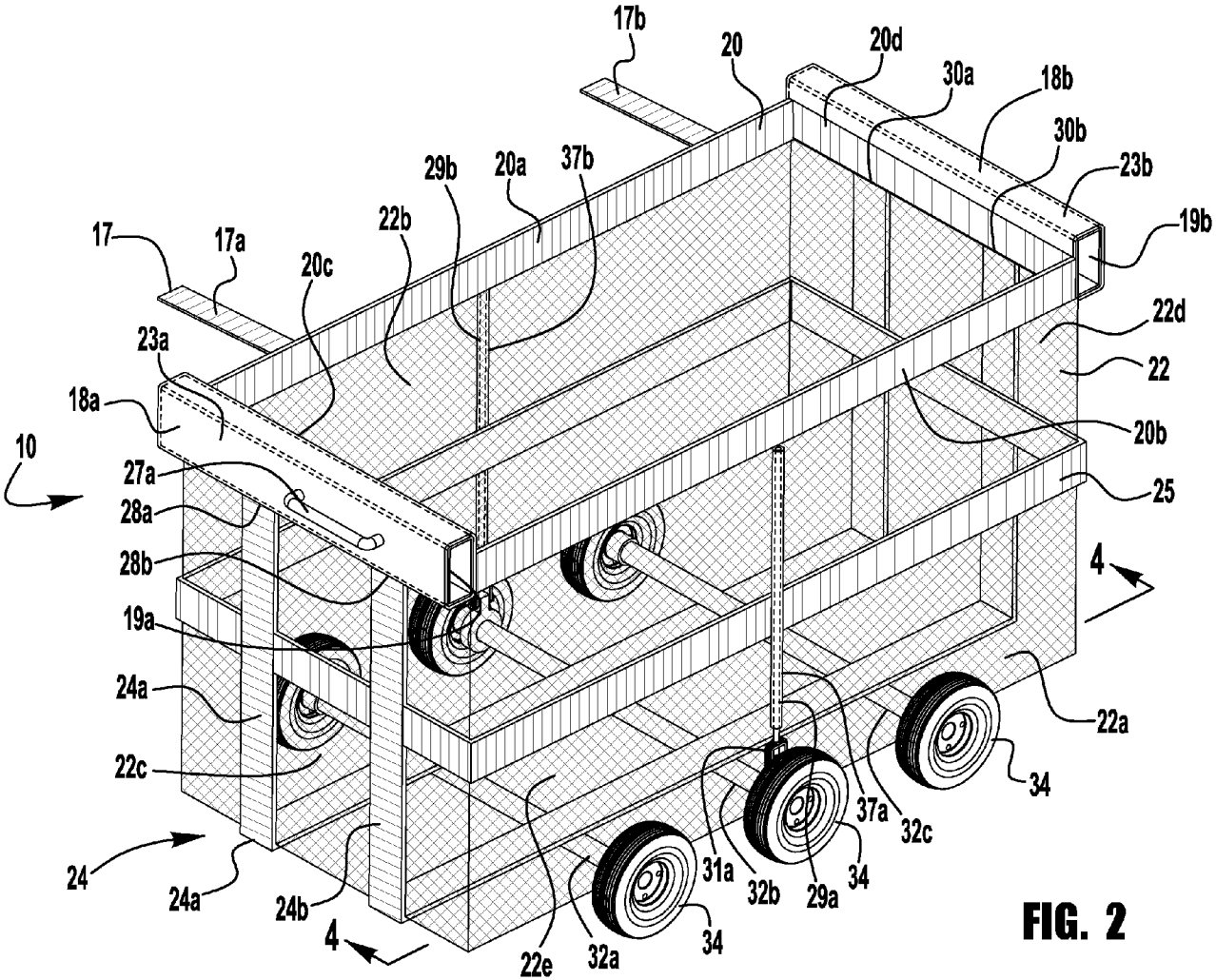
FIG. 2 is a front three-dimensional view of the portable trash container in an extended state, in accordance with the present invention.

As seen in FIG. 2, the portable trash container 10 consists of an upper frame 20 supporting rectangular tubes 18*a* and 18*b*, a collapsible mesh box or container 22, a plurality of support straps 24, including at least first and second straps 24*a* and 24*b*, third strap 25 and a plurality of axles 26, including first, second and third axles 26*a*, 26*b*, and 26*c*, having wheels at each end thereof. The portable trash container 10 may be of any appropriate dimensions, with an exemplary height having a range between about 2.5 feet and 3.5 feet, a length having a range between about 5 feet and six feet, and width having a range between about 2.5 feet and 3.5 feet. The portable trash container 10 must be sufficiently large to accommodate a wide array of refuse items of different dimensions and weights, such as furniture, boxes, refrigerators, and any other desired products.

FIG. 2 illustrates the portable trash container 10 in an extended state. The upper frame 20 consists of first and second side walls 20*a* and 20*b*, and first and second end walls 20*c* and 20*d*.

The side walls 20*a* and 20*b*, and end walls 20*c* and 20*d* are preferably constructed of a flexible, yet sturdy fabric, such as a heavy nylon strap. The first and second side walls 20*a* and 20*b* may have any desired length, with an exemplary range between about 5 feet and six feet and extend the length of the sidewalls 22*a* and 22*b* of the mesh container 22. Preferably the fabric end walls 20*c* and 20*d* and the fabric sidewalls 20*a* and 20*b* are constructed of a single length of fabric forming the upper frame 20.

The rectangular tubes 18*a* and 18*b* which accommodate the pair of hydraulic-powered forks 14*a* and 14*b* which extend from the truck 12 are disposed adjacent to the first and second end walls 20*c* and 20*d*.

The rectangular tubes 18*a* and 18*b* support the portable trash container 10 and the item or items therein when the pair of forks 14*a* and 14*b* lift the container and dispose of the item within the truck. Each of the rectangular tubes 18*a* and 18*b* is constructed of a material such as metal and includes a cavity 19*a* and 19*b* there though, respectively, into which the forks 14*a* and 14*b* are inserted.

The rectangular tubes 18*a* and 18*b* may be attached to first and second end walls 20*c* and 20*d* in any desired fashion. For example, the first and second end walls 20*c* and 20*d* can have sleeves 23*a* and 23*b*, respectively, secured thereto to receive the tubes 18*a* and 18*b*, respectively. The fabric end walls 20*c* and 20*d* can be secured to the inward facing sides of the sleeves 23*a* and 23*b*, respectively. Alternatively, the sleeves 23*a* and 23*b* can be formed as an extension of the mesh, i.e., the interwoven strands of metal, fiber, or other flexible/ductile materials, forming end walls 20*c* and 20*d* of the upper frame 20. Handles 27*a* and 27*b* can be connected to the sleeves 23*a* and 23*b*, best shown in FIG. 4.

As illustrated in FIG. 2, the two side walls 20*a* and 20*b* are fully extended. It should be noted that since the two side walls 20*a* and 20*b* are constructed of a flexible strap of fabric, the rectangular tubes 18*a* and 18*b* may be situated closer to each other by narrowing the distance between the two end walls 20*c* and 20*d*. Therefore, a wide array of the pair of forks 14*a* and 14*b* with varying sizes between the two forks may be utilized with the portable trash container 10. One or more straps 17, such as first and second straps 17*a* and 17*b* are attached to the first side wall 20*a* of upper frame 20. The purpose of the straps 17*a* and 17*b* is to provide extra support when the portable trash container 10 is being suspended over the cab 12*a* of the truck 12 and inverted to dump its contents into the refuse compartment 12*b*. As illustrated in FIG. 1, the straps 17*a* and 17*b* may be secured about a cross bar 13*a* of the hydraulic-powered lift 13 by any means such as with a Velcro fastener.

Figure 3:
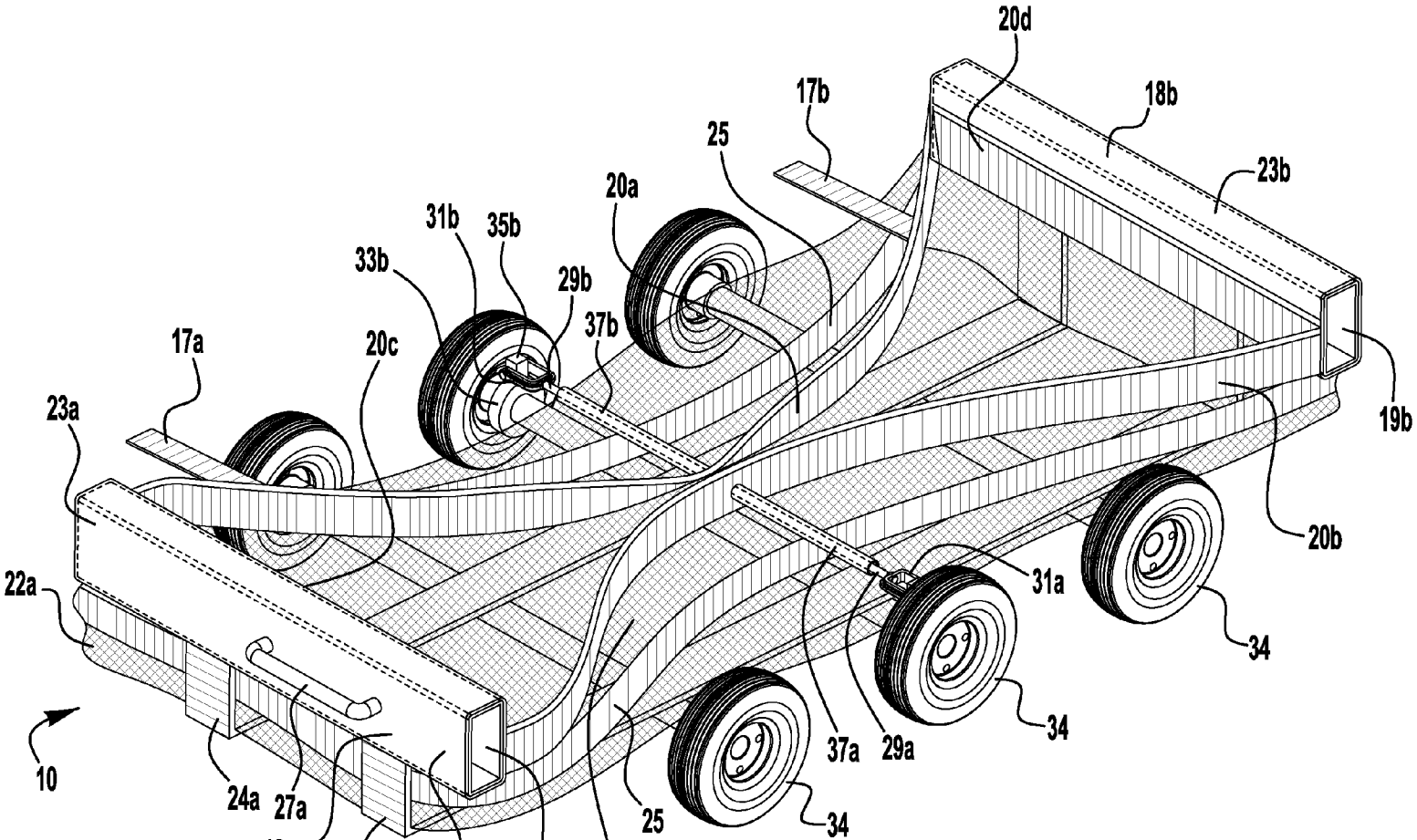
FIG. 3 is a front three-dimensional view of the portable trash container in a collapsed state, in accordance with the present invention.

As shown in FIGS. 1-4, the portable trash container 10 includes support rods 29*a* and 29*b* which are mounted at one end to u-shaped brackets 31*a*, 31*b*, respectively, that in turn are affixed to collars 33*b* (only one of which is shown), respectively, that are mounted to the ends of axle 26*b*. Projections 35*b* (only one of which is shown) extending upward from the collars 33*b* are attached to the U-shaped brackets 31*a*,31*b* by a pin so that the brackets and the attached support rods 29*a* and 29*b* have restricted movement in a single plane whereby the support rods 29*a*,29*b* can move between a position substantially parallel to axle 26*b* as shown in FIG. 3 to a position substantially perpendicular to axle 26*b* as shown in FIG. 2. The support rods 29*a* and 29*b* are each disposed in a sleeve 37*a*,37*b*, respectively, which is secured to the two side walls 20*a* and 20*b* of the upper frame 20.

The support rods 29*a* and 29*b* are provided to strengthen the side walls 22*a* and 22*b* of the mesh container when the latter is fully open as shown in FIG. 2. The support rods 29*a* and 29*b* ensure that the mesh container does not collapse when it is raised over the driver's cab and turned over to dump the contents into the refuse container behind the driver's cab.

As illustrated in FIG. 3, the portable trash container 10 is in a collapsed state. The two side walls 20*a* and 20*b* of the upper frame 20 are caused to be curved inward toward each other because the support rods 29*a* and 29*b* within the sleeve 37*a*,37*b*, move downwards with respect to collars 33*a* and 33*b*, respectively, that are mounted to the ends of axle 26*b* to a location a location parallel are to the axle 26*b*. When the portable trash container 10 is in the collapsed state as shown in FIG. 3, it can be rolled up beginning with the tube 18*a* within the sleeve 23*a* until it reaches the tube 18*b* within the sleeve 23*b*.

The mesh container 22 is a net barrier textile in which the strands of material forming the mesh container are looped or knotted at their intersections, resulting in a fabric with open spaces between the strands of material. Typically, the mesh container 22 is constructed of connected strands of metal, fiber, or other flexible/ductile materials. The material from which the mesh container 22 must be robust and durable so as to support a variety of items with varying shapes and weights. For example, the mesh container 22 may be constructed of plastic coated steel cable, or alternatively braided nylon or a similar material. Further, the nominal mesh openings in the mesh container 22 formed between the connected strands of material may have sizes of any desired dimension.

The mesh container 22 is secured to the upper frame 20 by any desired fashion such as by sewing the mesh container to the flexible strap forming the side walls 20*a* and 20*b* and end walls 20*c* and 20*d*. The attachment must be sturdy enough such that a particularly cumbersome or heavy article of refuse will not sever the connection between the mesh container 22 and the portable trash container 10.

The support straps 24, including first and second straps 24*a* and 24*b* are attached to the bottom surface 22*e* of container 22, to the first and second end walls 22*c* and 22*d* of the mesh container, and to the first and second end walls 20*c* and 20*d* of the upper frame 20. Typically, the support straps 24*a* and 24*b* will be constructed of the same material as the first and second end walls 20*c* and 20*d* and the first and second side walls 20*a* and 20*b*, although they may be constructed of any desired material. The straps 24*a* and 24*b* are designed to provide additional support to the portable trash container 10. A first end 28*a* and 28*b* of the first and second straps 24*a* and 24*b*, respectively, attach to the first end wall 20*c*. The straps 24*a* and 24*b* extend about the mesh container 22, as illustrated in FIG. 2, and attach to the second end wall 20*d* at a second end 30*a* and 30*b* of the first and second straps 24*a* and 24*b*, respectively. The first end 28*a* and 28*b* and the second end 30*a* and 30*b* may attach in any desired fashion, such as being sewn thereto or with an adhesive.

A third support strap 25 extends around the container 22 and is attached to the first and second side walls 22*a* and 22*b*, respectively and to the first and second end walls 22*c* and 22*d*, respectively. The third support strap 25 can be disposed between the upper frame 20 and the bottom surface 22*e* of mesh container 22. The strap 25 and 24*b* are designed to provide additional support to the portable trash container 10.

Figure 4:
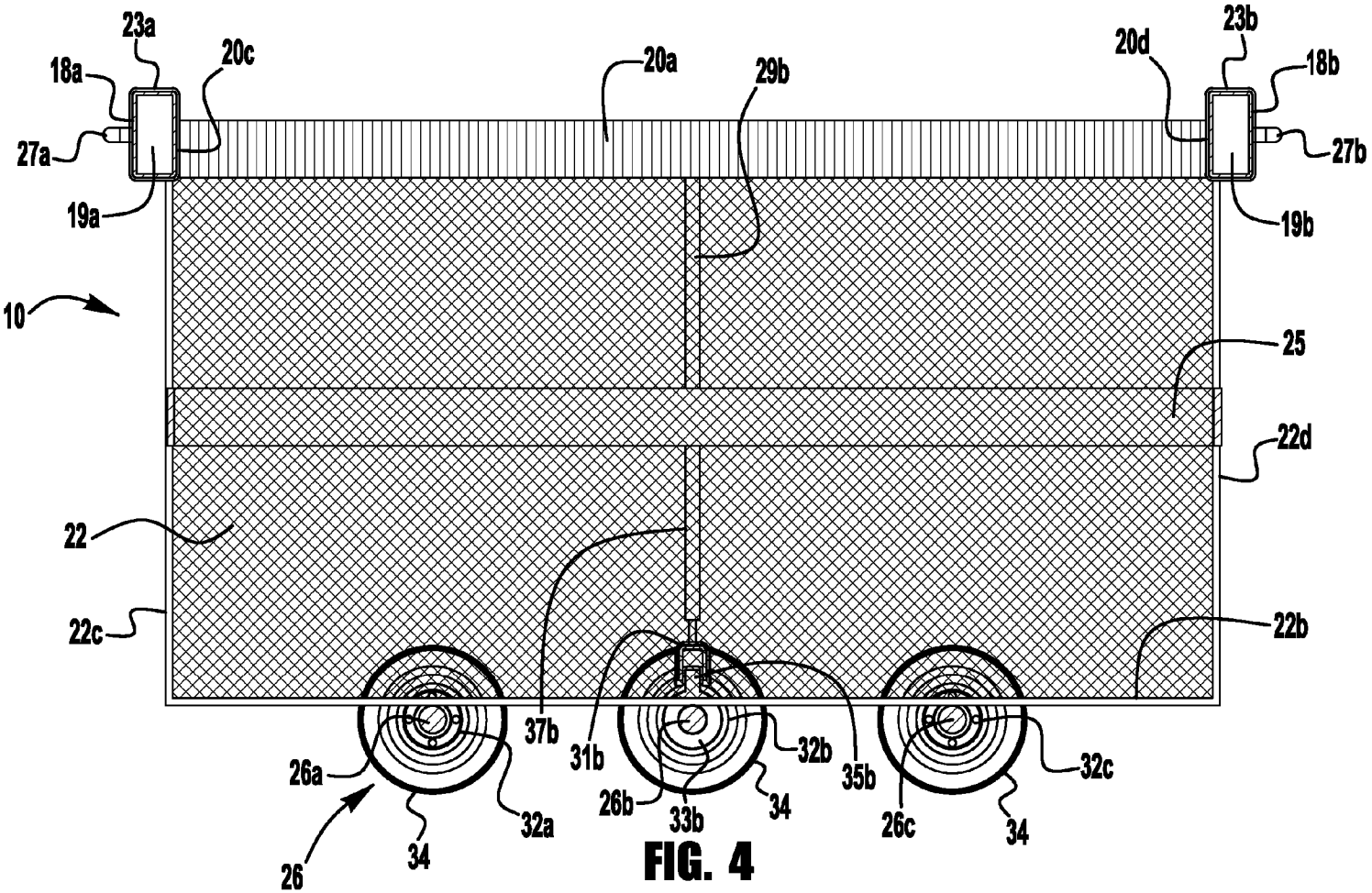
FIG. 4 is a cross-sectional view through line 4-4 of FIG. 2, in accordance with the present invention.

As illustrated in FIG. 2 and FIG. 4, the plurality of axles 26, including first, second and third axles 26*a*, 26*b*, and 26*c* (26*a*-26*c*) are disposed below the bottom wall 22*b* of the mesh container 22 and the support straps 24. The axles 26*a*-26*c* may have any desired length of about 3 feet. The axles 26*a*-26*c* are disposed within elongated sleeves or housings 32*a*, 32*b*, and 32*c* (32*a*-32*c*), respectively. Housings 32*a*-32*c* are typically lengths of material which may be attached directly to the bottom wall 22*b* of the mesh container 22, or to the first and second straps 24*a* and 24*b*, or a combination thereof. The axles 26*a*-26*c* are rotatable within the housings 32*a*-32*c*. Each of the axles 26*a*-26*c* has a wheel 34 on both ends, which allows the portable trash container 10 to be easily wheeled around. The wheels 34 may be mounted to the axles 26*a*-26*c* in any desired manner.

A method of use is provided using a portable trash container 10 with a hydraulic-powered lift 13 having a pair of forks 14*a* and 14*b* extending from a truck 12. The method includes providing the portable trash container 10 with an upper frame 20 constructed of first and second side walls 20*a* and 20*b* and first and second end walls 20*c* and 20*d* and a collapsible mesh container 22 secured to the upper frame. Further, a pair of tubes 18*a* and 18*b* is secured to the first and second side walls 20*c* and 20*d*. The collapsible mesh container 22 can be moved in a collapsed state to a location away from the truck 12 using handle 27*a*. Then, the mesh container can be expanded as shown in FIG. 2 with the support rods 29*a*,29*b* moved to a position substantially perpendicular to axle 26*b*. The one or more items can be placed within the collapsible mesh container and the collapsible mesh container 22 can be moved to a location adjacent the hydraulic-powered lift 13 having a pair of forks 14*a* and 14*b* extending from the truck 12. The pair of forks 14*a* and 14*b* are inserted into the pair of tubes 18*a* and 18*b*, and the forks are raised to raise the collapsible mesh container 22 while in an extended state above the cab of the truck. The collapsible mesh container is inverted and dumped so that the item therein is dumped into a refuse compartment 12*b* behind the cab of the truck 12. Note that the support rods 29*a*,29*b* prevent the container from collapsing when the container is inverted prior to dumping the contents into the refuse compartment.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. A portable trash container adapted to be used with an hydraulic-powered lift having a pair of forks extending from a truck, comprising:

an upper frame constructed of first and second side walls and first and second end walls;

a collapsible mesh container secured to the upper frame and comprising a bottom surface, first and second side walls, and first and second end walls;

a pair of tubes secured to the first and second end walls to receive the pair of hydraulic-powered forks;

a plurality of support straps attached to the collapsible mesh container and the upper frame wherein the plurality of support straps include first and second support straps attached to the bottom surface and the first and second side walls of the collapsible mesh container, and to the end walls of the upper frame, and a third support strap extending around the mesh container and attached to the first and second side walls and to the first and second end walls of the mesh container; and further including a plurality of axles mounted to the bottom surface of the collapsible mesh container, each of the axles having a wheel on both ends thereof.

2. The portable trash container of claim 1 further including a plurality of elongated sleeves attached to the bottom surface of the mesh container, each receiving one of the plurality of axles.

3. The portable trash container of claim 1 further including:

first and second support rods each mounted at a first end to one of the first and second side walls of the upper frame and at a second end to one of the plurality of axles to enable restricted movement in a single plane between a position substantially parallel to the one of the plurality of axles to a position substantially perpendicular to one of the plurality of axles.

4. The portable trash container of claim 3 further including:

first and second sleeves each secured to one of the two side walls of the upper frame and to one of the two side walls of the mesh container.

5. The portable trash container of claim 1 wherein the first and second side walls and first and second end walls of the upper frame are formed of a length of flexible fabric.

6. The portable trash container of claim 1 further including first and second sleeves secured to the first and second end walls of the upper frame to receive the tubes.

7. The portable trash container of claim 6 wherein inward facing sides of the first and second sleeves are secured to the end walls of the upper frame.

8. The portable trash container of claim 1 wherein the mesh container is constructed of a flexible, ductile material.

9. A method of using a portable trash container with a hydraulic-powered lift having a pair of forks extending from a truck, including:

providing the portable trash container having an upper frame constructed of first and second side walls and first and second end walls and a collapsible mesh container secured to the upper frame;

providing a pair of tubes secured to the first and second end walls;

moving the collapsible mesh container in a collapsed state to a location away from the pair of forks extending from a truck;

placing an item within the collapsible mesh container;

raising the collapsible mesh container into an extended state;

moving the collapsible mesh container in an extended state to a location adjacent the pair of forks extending from the truck;

inserting the pair of forks into the pair of tubes;

raising the pair of forks to raise the collapsible mesh container while in an extended state; and inverting the collapsible mesh container and dumping the collapsible mesh container so that the item therein is dumped into a refuse compartment within the truck;

wherein moving the collapsible mesh container includes moving the collapsible mesh container on wheels mounted to the mesh container with axles to a location away from the pair of forks;

mounting first and second support rods at a first end to one of the first and second side walls of the upper frame and at a second end to one of the plurality of axles; and moving the first and second support rods in a single plane between a position substantially parallel to the axles where the mesh container is in a collapsed state to a position substantially perpendicular to the axles where the mesh container is in an extended state.

10. The method of claim 9 wherein moving the collapsible mesh container includes moving the collapsible mesh container while in a collapsed state on wheels mounted to the mesh container to a location adjacent the pair of forks extending from the truck.

11. The method of claim 9 further including providing first and second sleeves secured to the first and second end walls to receive the tubes.

12. The method of claim 9 further including attaching one or more straps attached to the first side wall to the hydraulic lift of the truck to provide extra support when the collapsible mesh container is being emptied into the truck.

13. The method of claim 12 further including returning the mesh container after being emptied in the truck to a location adjacent the pair of forks extending from the truck.

14. The method of claim 13 further including lowering the pair of forks whereby the collapsible mesh container is moved into a collapsed state.

15. The method of claim 9 further including providing a plurality of support straps attached to the collapsible mesh container and the upper frame.

* * * * *